United States Patent [19]

Herber et al.

[11] Patent Number: 4,648,959

[45] Date of Patent: Mar. 10, 1987

[54] HYDROGENATION METHOD FOR ADSORPTIVE SEPARATION PROCESS FEEDSTREAMS

[75] Inventors: Raymond R. Herber, Medinah; Angelo P. Furfaro, Des Plaines, both of Ill.

[73] Assignee: UOP Inc., Des Plaines, Ill.

[21] Appl. No.: 891,078

[22] Filed: Jul. 31, 1986

[51] Int. Cl.[4] ..... C10G 65/04

[52] U.S. Cl. ..... 208/89; 208/58; 208/143; 208/99; 585/258; 585/264; 585/265; 585/841

[58] Field of Search ..... 208/89, 100, 58, 59, 208/84, 143, 144; 585/254, 258, 264, 265

[56] References Cited

U.S. PATENT DOCUMENTS

| | | | |
|---|---|---|---|
| 3,055,823 | 9/1962 | Mason et al. | 208/89 |
| 3,328,289 | 6/1967 | Streed | 208/89 |
| 3,392,113 | 7/1968 | De Rosset | 208/310 |
| 3,455,815 | 7/1969 | Fickel | 208/310 |
| 3,480,531 | 11/1969 | Mulaskey | 208/143 |
| 3,537,982 | 11/1970 | Parker | 208/143 |
| 3,697,413 | 10/1972 | Hamblin | 208/59 |
| 3,865,716 | 2/1975 | Sosnowski | 208/143 |
| 3,891,539 | 6/1975 | Nelson et al. | 208/59 |
| 4,006,197 | 2/1977 | Bieser | 260/676 MS |
| 4,436,533 | 3/1984 | Bannon | 55/26 |
| 4,451,354 | 5/1984 | Stuntz | 208/89 |
| 4,469,590 | 9/1984 | Schucker | 208/89 |
| 4,497,909 | 2/1985 | Itoh et al. | 502/262 |
| 4,520,214 | 5/1985 | Vora . | |
| 4,568,452 | 2/1986 | Richmond | 208/341 |

*Primary Examiner*—Andrew H. Metz
*Assistant Examiner*—Anthony McFarlane
*Attorney, Agent, or Firm*—Thomas K. McBride; John F. Spears, Jr.

[57] ABSTRACT

A process is disclosed for hydrotreating olefin-containing hydrocarbon streams for the purpose of producing very low olefin concentrations without the use of high pressure hydrotreating. The process is useful in preparing feeds to adsorptive separation zones. In the process the effluent of a hydrotreating reaction zone is passed into a stripping column. Preferably, substantially all liquid flowing downward through the lower section of the column is withdrawn and then passed through a hydrogenation reactor. The hydrogenation reactor effluent is passed into the bottom of the column to allow removal of dissolved hydrogen.

12 Claims, 1 Drawing Figure

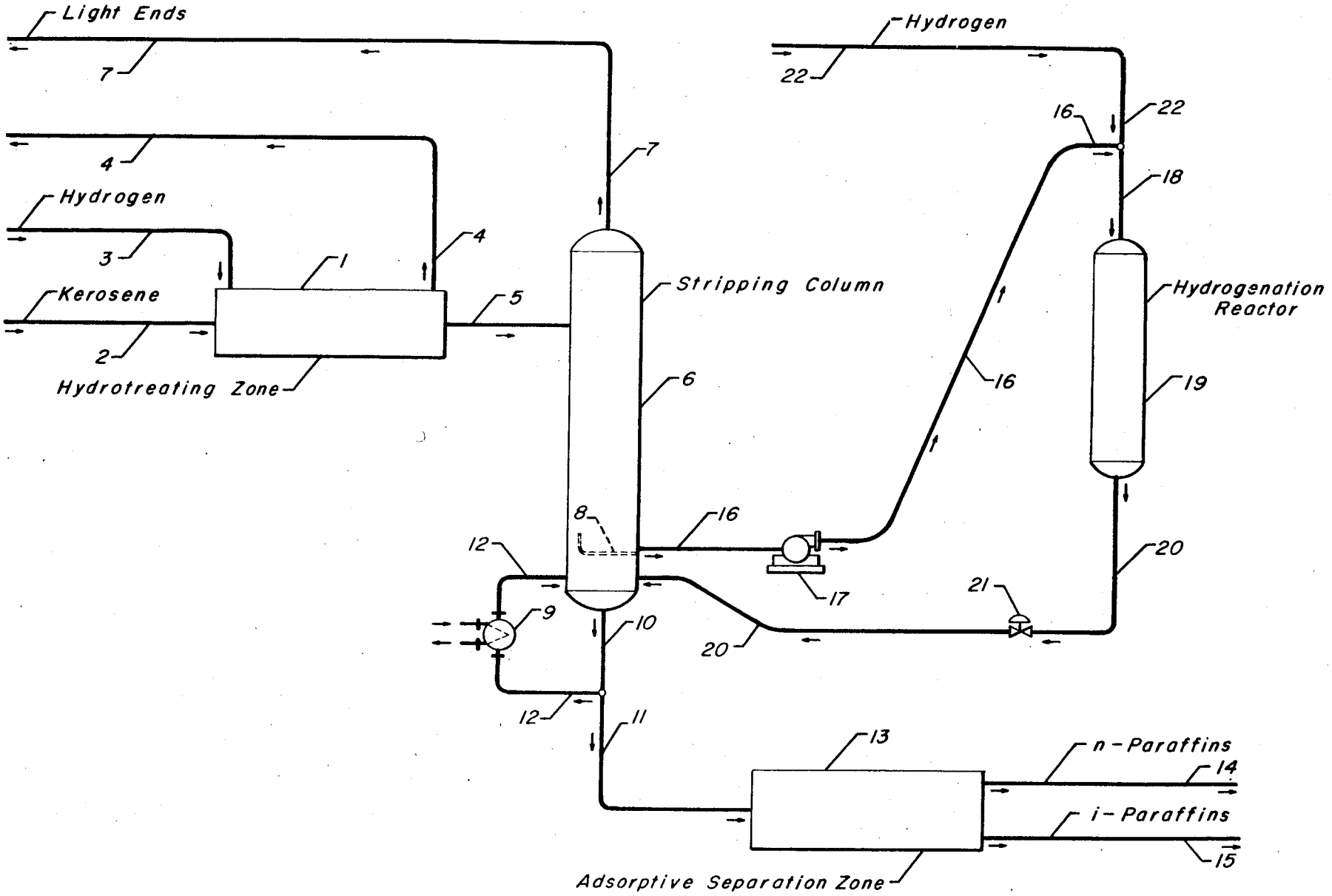
Hydrogenation Reactor
Hydrogen
Stripping Column
n - Paraffins
i - Paraffins
Adsorptive Separation Zone
Light Ends
Hydrogen
Kerosene
Hydrotreating Zone
1
2
3
4
5
6
7
8
9
10
11
12
13
14
15
16
17
18
19
20
21
22

HYDROGENATION METHOD FOR ADSORPTIVE SEPARATION PROCESS FEEDSTREAMS

FIELD OF THE INVENTION

The invention relates to a hydrocarbon conversion process in which a feedstream comprising an admixture of paraffinic hydrocarbons and a small amount of olefinic hydrocarbons is treated to reduce the concentration of olefinic hydrocarbons to a very low level. The invention is specifically related to processes for the hydrogenation of naphtha or kerosene boiling range hydrocarbon streams. The preferred field of use of the subject invention is in the area of the feed pretreatment steps performed in an overall adsorptive separation process.

PRIOR ART

The hydrotreating or hydrogenation of hydrocarbons is one of the most basic of the hydrocarbon conversion processes. It is performed in most modern petroleum refineries and in many petrochemical installations. There is therefore a voluminous body of art on the subject of hydrogenation of hydrocarbons. An exemplary reference which describes the production and use of a suitable hydrogenation catalyst is provided in U.S. Pat. No. 3,480,531 issued to B. F. Mulaskey. U.S. Pat. No. 4,497,909 issued to T. Itoh et al. is also believed pertinent for its teaching of hydrotreating process conditions and catalyst which may be used in the subject invention.

It is well known in the art and the standard operating practice that the feedstream to a hydrogenation zone is admixed with hydrogen and passed through a bed of hydrogenation catalyst maintained at suitable operating conditions. The effluent stream of this reactor is then normally passed into a vapor-liquid separation zone. A vapor phase stream is removed in this separation zone and may be discharged from the process or recycled in part as a hydrogen-containing recycle gas stream. The liquid phase material from the vapor-liquid separation zone is typically passed into a fractionation column operated as a stripping column for the removal of any light hydrocarbons produced by cracking reactions during the hydrogenation or hydrotreating step and for the simultaneous removal of dissolved hydrogen from the liquid phase stream. In some instances, this stripping step may not be required. It is also known that in some instances in which a very mild hydrogenation is required that only a stoichiometric or less amount of hydrogen need be admixed with the feedstream and that the vapor-liquid separation zone would not be required.

The adsorptive separation of various chemical compounds is also a well-developed and commercially practiced process. Representative examples of such processes are provided in U.S. Pat. Nos. 3,455,815 issued to R. G. Fickel and 4,006,197 issued to H. J. Bieser. Both of these references describe processes using molecular sieve type adsorptive compounds to separate straight chain paraffins for a mixture of isoparaffins and normal paraffins. The operating procedures, conditions, adsorbents and feed materials are similar to those which may be employed in the subject invention. U.S. Pat. No. 4,436,533 issued to R. P. Bannon is also believed pertinent for its teaching of a different process for the continuous adsorptive separation of normal paraffins from a hydrocarbon feed mixture.

U.S. Pat. No. 3,392,113 issued to A. J. De Rosset is also pertinent for its teaching in regard to the adsorptive separation of normal paraffins from a hydrocarbon mixture. In addition, this reference is pertinent for its showing of the passage of the feed hydrocarbon stream of line 2 through a hydrorefining reactor 5 in admixture with hydrogen. The effluent of the reactor is passed through a vapor-liquid separation zone 8 with the liquid phase stream recovered from this separation zone being passed into a stripping column 14. The net bottoms stream of the stripping column is passed through line 63 into the adsorptive separation sequence of the reference.

U.S. Pat. No. 4,568,452 issued to R. P. Richmond is believed pertinent for its showing of the removal of a liquid wash oil stream from an intermediate point on a fractionation column and the passage of this stream through a hydrorefining zone wherein it is contacted with a catalyst and hydrogen. At least a portion of the hydrotreated effluent is returned to the fractionation column.

BRIEF SUMMARY OF THE INVENTION

The invention is a method of hydrogenation or hydrotreating which produces treated hydrocarbon streams having very low olefin contents. The subject invention is uniquely adaptable to existing hydrotreating units in which is desired to reduce the olefin content of the treated product stream. In addition, the subject process has the advantage of effecting this reduction in the olefin concentration without resorting to substantially increased operating pressures which may require the replacement of relatively expensive equipment including reaction vessels and compressors in an existing hydrotreating zone. The invention functions by removing liquid from a lowermost portion of the stripping portion of the column of a hydrotreating zone and passing this liquid stream through an additional hydrogenation reactor. By utilizing a total trapout tray, all of the liquid may be withdrawn and passed through the second hydrogenation reactor such that all of the liquid is treated. The treated liquid is then preferably passed into the bottom portion of the column to allow at least partial separation of any residual hydrogen from the treated hydrocarbon stream.

One embodiment of the subject invention may be characterized as a hydrogenation process which comprises the steps of passing a feedstream, which stream comprises a $C_5$-plus paraffinic hydrocarbon and an olefinic hydrocarbon having the same number of carbon atoms as said paraffinic hydrocarbon, and hydrogen into a hydrotreating zone comprising a first reaction zone containing a bed of solid catalyst and operated at hydrotreating conditions and producing a hydrotreating zone effluent stream which comprises hydrogen and said paraffinic and olefinic hydrocarbons and which contains less than about 0.05 mole percent olefinic hydrocarbons; passing the hydrotreating zone effluent stream into a stripping column operated at conditions effective to separate entering materials into a net overhead stream comprising hydrogen and a net bottoms stream comprising the paraffinic hydrocarbon; collecting and withdrawing from the column as a first process stream substantially all of the liquid-phase hydrocarbons which are flowing downward through the column at a point which is effectively below the lowermost vapor-liquid contacting media present in the column and above a liquid retention volume provided in the bottom of the column; passing the first process stream through a second reaction zone comprising a bed of hydrogenation catalyst and operated at hydrogenation conditions and producing a second process stream comprising hydrogen and the paraffinic hydrocarbon; passing the second process stream into the liquid retention volume of the stripping column; and, removing the net bottoms stream as a product stream which contains less than about 0.01 mole percent olefinic hydrocarbons.

BRIEF DESCRIPTION OF THE DRAWING

The drawing is a simplified process flow diagram wherein kerosene from line 2 passes through the hydrotreating zone 1, with the effluent of the hydrotreating zone being stripped in column 6. Just above the bottom of the column the liquid flowing downward is removed through line 16 and passed through the hydrogenation reactor 19 prior to being returned to the base of the stripping column through line 20.

DETAILED DESCRIPTION

As shown by the previously cited reference hydrotreaters have been used in the past and are presently being used to prepare a feedstream which, after having been stripped in a suitable fractionation column, is charged to an adsorptive separation zone. However, in some instances it has become apparent that it is advisable to further reduce the olefin content of the material being charged to the adsorptive separation process below the level which may be obtained within the hydrotreating zone. An increased capacity to reduce olefin concentration may be desired due to the use of an olefin sensitive adsorbent or to an increase in the olefin concentration of the original feedstream. More severe operating conditions within the hydrotreating zone can be employed to effect a further reduction in the olefin content of this stream. However, the necessary conditions may exceed the design specifications of the hydrotreating unit and may therefore require rather extensive and expensive revamping of this unit.

It is therefore an objective of the subject invention to provide a process for the improved hydrogenation of olefin-containing hydrocarbon streams. It is a specific objective of the subject invention to provide a process which will reduce the olefin content of a feedstream to an adsorptive separation process which is separating normal paraffins from a mixture of nonnormal and normal paraffins. While the subject process can be applied to essentially any feedstock containing $C_5$-plus hydrocarbons, the preferred feeds, and hence the net bottoms stream or product of the process, is a heavier hydrocarbon. Preferably the net bottoms stream and feedstream comprise $C_8$-plus hydrocarbons such as an admixture of $C_{11}$ to $C_{15}$ hydrocarbons.

The drawing is a simplified process flow diagram wherein a kerosene boiling range feed stream from line 2 passes through the hydrotreating zone 1, in admixture with hydrogen supplied through line 3 with the effluent of the hydrotreating zone being passed through line 5 and stripped in column 6. Within the hydrotreating zone various contaminants such as sulfur, nitrogen or oxygen-containing compounds are acted upon to effect their destruction or conversion to compounds which are easily removed by stripping. Another primary function of the hydrotreating zone is to saturate olefinic hydrocarbons. An off-gas stream of line 4 discharges hydrogen and light ends. Just above the bottom of the column the liquid flowing downward is collected in trapout tray 8. It is removed through line 16 and passed through the hydrogenation reactor 19 prior to being returned to the base of the stripping column through line 20. Also charged to the hydrogenation reactor 19 is a high-purity stream of hydrogen carried by line 22. The charge admixture of hydrogen and liquid-phase hydrocarbons flows through line 18 into the reactor.

The hydrogenation reactor is preferably operated at a higher pressure than the stripping column 6, with the liquid feed to the reactor being pressurized in the pump 17. The effluent of the reactor is depressured through the pressure control valve 21 into the base of the stripping column. This reduction in pressure tends to release any excess hydrogen dissolved in the effluent stream flowing through line 20. This hydrogen passes upward through the stripping column and emerges as a portion of the light ends stream of line 7. The light ends stream is the net overhead stream of the stripping column and will comprise hydrogen from the liquid phase streams of lines 5 and 20 and any light hydrocarbons such as methane, ethane or propane which result from cracking reactions within the hydrotreating zone or the hydrogenation reactor.

A quantity of liquid phase hydrocarbons is collected in the bottom of the stripping column below the imperforate trapout tray 8. The material retained in this collection zone is withdrawn through line 10 and divided into a first portion which is recycled through line 12 and the external reboiler 9 and a second portion which is removed as the net bottoms stream of the column. The material flowing through line 12 should be partially vaporized to generate vapors required for the fractional distillation process conducted within the column 6.

The net bottoms stream of line 11 will comprise an admixture of kerosene boiling range hydrocarbons having a very low olefin and hydrogen content. This liquid phase stream is passed into the adsorptive separation zone 13, which preferably is operated in accordance with the description herein. The stream of line 11 is therefore preferably brought into a contact with a fixed bed of a solid adsorptive material which preferentially adsorbs normal paraffins to the exclusion of the isoparaffins and other nonnormal paraffins. The normal paraffins are then dislodged from the adsorptive solid through the use of a desorbent compound. The unadsorbed isoparaffins and the adsorbed normal paraffins are also therein preferably separated from the desorbent component(s) to generate relatively high-purity effluent streams of normal paraffins discharged by line 14 and isoparaffins discharged by line 15. As the feed material to the adsorptive separation zone 13 comprises an admixture of different hydrocarbons having a range of carbon numbers, both of the product streams will also contain a number of different hydrocarbons and will have the same carbon number range as the feed kerosene boiling point admixture. Preferably, the boiling point range of the feed material of line 2 and of line 11 will be adjusted to be in a relatively narrow band such that only a preselected range of carbon numbers will be present within the product streams.

The hydrotreating zone 1 which processes the feedstream prior to passage into the stripping column is preferably operated at more severe conditions than the hydrogenation reactor 19 which processes the liquid withdrawn from the stripping column. The hydrotreating zone may contain one or more reaction vessels containing fixed, moving or ebulated, etc. beds of catalyst. Preferably, a single hydrotreating zone containing a fixed bed of catalyst and operated with a vertical flow of the reactants through the catalyst bed is utilized within the hydrotreating zone. The reaction zone of the hydrotreating zone may be operated at a pressure of from about 100 psig (2068 k Pag) to about 2000 psig (13790 k Pag). Preferably, the pressure within this reaction zone is below 1200 psig (8266 k Pag). This reaction zone may be operated with a maximum catalyst bed temperature in the range of about 180 degrees Celsius to about 450 degrees Celsius but is preferably operated at a temperature between 200 degrees Celsius and 400 degrees Celsius. The liquid hourly space velocity maintained through the reactor may vary from about 0.2 hours$^{-1}$ to about 10 hours$^{-1}$ and the hydrogen circulation rate will preferably be within the broad range of from about 200 standard cubic feet per barrel (SCFB) (35.6 $m^3/m^3$) to about 8000 SCFB (1422 $m^3/m^3$).

The term "hydrotreating zone" is intended to encompass the needed equipment to heat and pressurize the desired feed hydrocarbons and hydrogen, the reaction vessel or vessels, the initial product separation zone which is normally one or more vapor-liquid separation zones and the heat exchangers typically employed within this zone to heat the reactants or to recover heat. The exact operating conditions employed within the hydrotreating reaction zone would be dependent upon the composition of the entering feedstream, the activity and quantity of the catalyst provided, and other such factors which are balanced to obtain a satisfactory performance within this zone. The typical function of this zone is to convert substantially all of the sulfur present in the feed materials to hydrogen sulfide, to convert nitrogen present in the feed to ammonia and to saturate olefinic and diolefinic hydrocarbons present within feed material. If the feed material contains any significant amount of aromatic hydrocarbons a further function of the hydrotreating zone would be the saturation and conversion of these compounds to acyclic compounds. If the subject process is used as shown in the drawing for the production of highly pure streams of iso- and normal paraffins, then the bulk of the aromatic compounds will normally be removed from the precursor of the feedstream of line 2 as by liquid-liquid extraction or adsorptive separation.

The hydrotreating zone would normally produce a liquid phase effluent stream which is passed into the stripping column. However, it is also known that the feed to a fractionation column may be partially vaporized and the feedstream entering the stripping column may therefore comprise an admixture of vapor and liquid. The design and operation of the stripping column or fractionation zone, other than that design necessary to practice the liquid withdrawal and addition necessary to the subject invention, do not form an essential element of the invention. Therefore, conventional and well-known fractional distillation equipment and conditions may be employed within the stripping column. Preferably, a single trayed fractionation column is employed although the fractionation zone could encompass two or more integrated fractionation columns.

As shown in the drawing, preferably all of the chemical compounds entering the stripping column are separated into the net overhead stream and the net bottoms stream of the column. Alternatively, additional streams may be withdrawn from the fractionation column by withdrawing sidecut streams at intermediate points between the top and bottom of the column. The fractionation column is preferably operated at a postive atmospheric pressure with suitable operating pressures ranging from about 60 k Pag to about 1400 k Pag. The column could, however, be operated at pressures outside of this range if so desired. For the stripping of the preferred kerosene boiling range feedstream, a fractionation column containing about 20 sieve trays should be adequate. The temperature at which the fractionation column is operated is of course set by the composition of the materials being separated and the pressure at which the column is operated. The column will normally be operated with a bottoms temperature below about 250 degrees Celsius, with a temperature above about 100 degrees Celsius being preferred.

The lowermost portion on the column is preferably employed as a liquid retention zone which is filled with liquid phase hydrocarbons during the performance of the subject process. Just above the intended upper level of this liquid retention zone, and below the vapor-liquid contacting means of the column, there is located the upper surface and entrance to a liquid trapout or withdrawal tray represented by tray 8 of the drawing. Preferably, this is a mechanical seal extending horizontally across the cross section of the column in a manner which traps and collects essentially all downward flowing liquid. The trapout tray or liquid collecting means preferably does not extend across the entire cross section of the column in order to provide an opening for the upward passage of vapors generated in the reboiling means upward into the main portion of the column. Those skilled in the art will recognize that there are many mechanical contrivances which can be configured within the column or possibly extended outside of the column to perform this function of collecting the descending liquid. The trapout "tray" could therefore be in the form of a cylinder extending downward into the bottom portion of the column. To ensure that the trapout or collection means remains full of liquid, which is desirable since this volume serves as the surge drum for the pump which is pressurizing liquid into the hydrogenation reactor, a one-way inlet valve means may be associated with such an elongated collection means such that liquid present in the bottom of the column may flow into the trapout tray.

The liquid phase material is continuously withdrawn from the trapout tray as a stream referred to herein as a sidecut stream. This stream is passed through a hydrogenation reactor in admixture with hydrogen added from an external source. Preferably, this stream is pressurized through the use of a pump prior to being passed into the hydrogenation reactor. The pump also functions to circulate the hydrocarbons through the reactor at an acceptable rate despite the inherent pressure drops. Another purpose of the pressurization is to ensure liquid phase conditions within the hydrogenation reactor and to increase the solubility of hydrogen within the liquid hydrocarbons. An increased hydrogenation zone operating pressure also increases the performance of the hydrogenation reactor. The minor amount of saturation which will occur in the hydrogenation reactor will release some heat resulting in a minor but normally insignificant heating of the reactants as they pass through the hydrogenation reactor. The effluent of the hydrogenation reactor is preferably passed through a pressure reducing means such as an adjustable pressure control valve or a fixed orifice located in a transfer line connecting the outlet of the hydrogenation reactor to a bottom portion of the stripping column. The pressure reduction aids in the release of any residual hydrogen present in the effluent of the hydrogenation reactor. This is desirable since the liquid being returned to the bottom of the column would not be subjected to a true stripping action.

It should be noted that the withdrawal of the liquid to be passed through the hydrogenation reactor from the "trapout tray" rather than from the bottom of the stripping column results in all of the material which passes into the bottom of the stripping column having passed through the hydrogenation reactor. If instead a portion of the bottoms liquid of the column was charged into the hydrogenation reactor, there would result a dilution or backmixing due to the addition of the untreated descending liquid into the reservoir of partially treated liquid contained within the bottom of the column. The hydrogenation action would therefore not be as complete as with the subject process flow. This is an advantage of the subject process.

An additional advantage of the subject process is the utilization of the bottom of a stripping column to effect at least a partial removal of hydrogen and light ends which may be present within the hydrogenation reactor effluent. This may be highly beneficial when it is desired to minimize the hydrogen content of the net bottoms stream of the stripping column. In this respect, it must be noted that this is a beneficial advantage over simply locating the hydrogenation reactor in line 11 or a similar location in which it would merely treat the net bottoms stream of the stripping column.

The operating conditions in the hydrogenation reactor would in general be relatively mild for a hydrotreating process. Preferably, the operating temperature of the hydrogenation reactor is set by the temperature at which the sidecut stream is withdrawn from the stripping column. A preferred operating temperature range is from 120 degrees Celsius to 200 degrees Celsius. The hydrogenation reactor may be operated at a pressure ranging from about 140 to about 2100 k Pag. Preferably, the hydrogenation reactor is operated in the pressure range from about 350 to about 700 k Pag.

Both the upstream hydrotreating zone and the hydrogenation reactor contain a bed of catalyst. The same or different catalyst may be employed within the two reactors. Highly suitable catalysts are available commercially from a number of manufacturers. A catalyst suitable for use in either zone may be described in general terms as comprising at least one metallic component having hydrogenation activity which is supported upon a suitable refractory inorganic carrier material of either synthetic or natural origin. The precise composition and method of manufacturing the finished or the carrier material is not considered material to the invention. The preferred carrier material is alumina, with silica, mixtures of silica and alumina or a number of synthetic materials such as zeolites also being suitable for use as the support or carrier material. The metallic components of the catalyst are normally selected from the metals of Groups VI-B and VII of the periodic table of the elements, E. H. Sargent and Co., copyright 1964. Of these materials, the most commonly used are nickel, palladium, platinum, molydenum, and tungsten. The use of nickel is preferred, with the nickel preferably comprising from about 0.2 to about 2.5 weight percent of the finished catalytic composite. The metallic component may be present in its elemental form, as an oxide or as a sulfide. The utilization of a sulfided catalyst is normally preferred for the hydrogenation zone to minimize any cracking tendency of the metallic component of the catalyst. Further information on the preparation and use of hydrogenation catalysts and hydrotreating catalyst may be obtained by reference to U.S. Pat. Nos. 4,497,909 and 4,568,655. The teaching of U.S. Pat. No. 3,480,531, which relates to the preparation and usage of hydrogenation catalysts, is expressly incorporated by reference.

In one embodiment of the invention the net bottoms stream of the stripping column, which has been treated through use of the hydrogenation reactor, is passed into an adsorptive separation zone. The separation of various hydrocarbonaceous compounds through the use of selective adsorbents is widespread in the petroleum, chemical and petrochemical industries. Adsorption is often utilized when it is more difficult or expensive to separate the same compounds by other means such as by fractionation. Examples of such adsorptive separation processes include the separation of ethylbenzene from a mixture of xylenes, the separation of a particular xylene isomer such as paraxylene from a mixture of $C_8$ aromatics, the separation of one sugar such as glucose from a mixture of two or more sugars such as glucose and fructose, the separation of acyclic olefins from acyclic parafffins and the separation of normal paraffins from isoparaffins. The selectively adsorbed material will normally have the same number of carbon atoms per molecule as the nonselectively adsorbed materials and will have very similar boiling points, a feature which makes separation by fractional distillation very difficult. A very common application of adsorptive separation is the recovery of a particular class of hydrocarbons from a broad boiling point range mixture of two or more classes of hydrocarbons. An example of this is the separation of $C_{10}$–$C_{14}$ normal paraffins from a mixture which also comprises $C_{10}$–$C_{14}$ isoparaffins.

Adsorptive separation processes may be performed using a variety of operating techniques. For instance, the adsorbent may be retained as a fixed bed or transported through the adsorption zone as a moving bed. In addition, techniques may be employed to simulate the movement of the adsorbent bed. The adsorptive separation zone can therefore comprise a simple swing-bed system with one or beds of adsorbent being used to collect the desired chemical compound(s) while previously used beds are being regenerated as by the use of a desorbent, a temperature increase, a pressure decrease, or a combination of these commonly regeneration techniques. A further possible variation in the operation of the adsorptive separation zone results from the possibility of operating the adsorbent beds under either vapor phase or liquid phase conditions. The use of liquid phase methods is preferred.

A preferred configuration for the adsorptive separation zone in the preferred simulated moving bed technique is described in some detail in the previously referred to U.S. Pat. Nos. 3,392,113; 3,455,815; and 4,006,197 which are incorporated herein by reference. These references describe suitable operating conditions and methods and suitable adsorbents for use in the separation of isoparaffins and other nonnormal hydrocarbons such as aromatics from normal paraffins. Further information on adsorptive techniques in the preferred operating methods may be obtained by reference to U.S. Pat. Nos. 3,617,504; 4,133,842; and 4,434,051. An entirely different type of simulated moving bed adsorptive separation which can be employed to recover either the isoparaffins or normal paraffins present in the bottom stream of the stripping column is described in U.S. Pat. Nos. 4,402,832 and 4,498,991. This process simulates a continuous cocurrent movement of the adsorbent relative to the fluid flow, whereas the preferred adsorptive separation technique utilizes simulated countercurrent movement of the adsorptive material in fluid flows.

The preferred operating conditions for the adsorbent containing chambers used in the separation step include a temperature of from 25 to about 225 degrees Celsius and a pressure of from atmospheric to about 4000 k Pag. The pressure is normally set as being sufficient to maintain liquid phase conditions within all points of the adsorptive separation process. The adsorbents which are preferred for the separation of normal paraffinic hydrocarbon from isoparaffinic hydrocarbons have relatively uniform pore diameters of about 5 angstroms such as the commercially available type 5A molecular sieves produced by the Linde division of Union Carbide corporation. Previously cited U.S. Pat. No. 4,436,533 describes the vapor phase separation of a $C_{11}$ to $C_{14}$ kerosene stream into a normal paraffin containing adsorbate and a nonnormal paraffin containing raffinate under vapor phase conditions at a pressure of approximately 469 k Pag and a temperature of about 349 degrees Celsius using the preferred type 5A molecular sieves.

Due to the upstream hydrotreating operation, the hydrotreating zone effluent stream being passed into the stripping column will have a relatively low olefin content. Normally, this stream will contain less than 0.2 mole percent olefins. The hydrotreating zone effluent stream may contain less than about 0.05 mole percent olefins. The subject process should result in the bottom stream of the stripping column having a olefin content which is less than one-fifth that of the charge stream (hydrotreating zone effluent stream). It is preferred that the bottoms stream of the stripping column contains less than about 0.05 mole percent olefins and more preferably less than 0.002 mole percent olefins. This reduction in the olefin content of the material being sent to the adsorptive separation zone should result in an improved service life of the adsorbent being employed in the adsorptive separation zone.

One embodiment of the invention may be accordingly described as a process which comprises the steps of passing a feedstream, which stream comprises a first $C_5$-plus paraffinic hydrocarbon, a second paraffinic hydrocarbon and an olefinic hydrocarbon both having the same number of carbon atoms as said paraffinic hydrocarbon, and hydrogen into a hydrotreating zone comprising a first reaction zone containing a bed of solid catalyst and operated at hydrotreating conditions and producing a hydrotreating zone effluent stream which comprises hydrogen and said paraffinic and olefinic hydrocarbons and which contains less than about 0.05 mole percent olefinic hydrocarbons; passing the hydrotreating zone effluent stream into a stripping column operated at conditions effective to separate entering materials into a net overhead stream comprising hydrogen and a net bottoms stream comprising the paraffinic hydrocarbon; collecting and withdrawing from the column as a first process stream substantially all of the liquid-phase hydrocarbons which are flowing downward through the column at a point which is below essentially all of the lowermost vapor-liquid contacting media present in the column and above a liquid retention volume provided in the bottom of the column; passing the first process stream through a second reaction zone comprising a bed of hydrogenation catalyst and operated at hydrogenation conditions and producing a second process stream comprising hydrogen and the paraffinic hydrocarbons; passing the second process stream into the liquid retention volume of the stripping column; and, passing the net bottoms stream into an adsorptive separation zone wherein the net bottoms stream is contacted with a bed of a shape selective adsorbent under adsorptive separation conditions and thereby producing a third process stream which is rich in the first paraffinic hydrocarbon and a fourth process stream which is rich in the second paraffinic hydrocarbon, and withdrawing the third and fourth process streams from the process as product streams. Preferably, the third process stream is rich in an isoparaffinic hydrocarbon and the fourth process stream is rich in a normal paraffinic hydrocarbon.

What is claimed:

1. A hydrogenation process which comprises the steps:

(a) passing a feedstream, which feedstream comprises a $C_5$-plus paraffinic hydrocarbon and an olefinic hydrocarbon having the same number of carbon atoms as said paraffinic hydrocarbon, into a hydrotreating zone comprising a first reaction zone containing a bed of solid hydrotreating catalyst and producing a hydrotreating zone effluent stream which comprises said paraffinic and said olefinic hydrocarbons and a light by-product hydrocarbon having fewer carbon atoms than said paraffinic hydrocarbon;

(b) passing the hydrotreating zone effluent stream into a fractionation column operated at conditions effective to separate entering hydrocarbons into a net bottoms stream comprising said paraffinic hydrocarbon and a net overhead stream comprising said by-product hydrocarbon;

(c) removing a sidecut stream which comprises said paraffinic and said olefinic hydrocarbon from the fractionation column at a point immediately above a liquid retention volume provided in the bottom of the fractionation column, with the sidecut stream having a flowrate equal to substantially all of the liquid flowing downward through the fractionation column at this point;

(d) passing the sidecut stream and hydrogen through a second reaction zone, which second reaction zone contains a bed of hydrogenation catalyst and is operated at hydrogenation conditions, and producing a reaction zone effluent stream comprising the paraffinic hydrocarbon and hydrogen;

(e) passing the reaction zone effluent stream into the liquid retention volume of the fractionation column; and, (f) removing the net bottoms stream as a product stream.

2. The process of claim 1 wherein the hydrotreating zone effluent stream comprises dissolved hydrogen.

3. The process of claim 1 wherein the concentration of olefinic hydrocarbons in the hydrotreating zone effluent stream is less than about 0.05 mole percent.

4. The process of claim 3 wherein the feedstream comprises an admixture of kerosene boiling range hydrocarbons.

5. A hydrogenation process which comprises the steps:

(a) passing a feedstream, which stream comprises a $C_5$-plus paraffinic hydrocarbon and an olefinic hydrocarbon having the same number of carbon atoms as said paraffinic hydrocarbon, and hydrogen into a hydrotreating zone comprising a first reaction zone containing a bed of solid catalyst and operated at hydrotreating conditions and producing a hydrotreating zone effluent stream which comprises hydrogen and said paraffinic and olefinic hydrocarbons and which contains less than about 0.05 mole percent olefinic hydrocarbons;

(b) passing the hydrotreating zone effluent stream into a stripping column operated at conditions effective to separate entering materials into a net overhead stream comprising hydrogen and a net bottoms stream comprising the paraffinic hydrocarbon;

(c) collecting and withdrawing from the column as a first process stream substantially all of the liquid-phase hydrocarbons which are flowing downward through the column at a point which is effectively below the lowermost vapor-liquid contacting media present in the column and above a liquid retention volume provided in the bottom of the column;

(d) passing the first process stream through a second reaction zone comprising a bed of hydrogenation catalyst and operated at hydrogenation conditions and producing a second process stream comprising hydrogen and the paraffinic hydrocarbon;

(e) passing the second process stream into the liquid retention volume of the stripping column; and, (f) removing the net bottoms stream as a product stream which contains less than about 0.01 mole percent olefinic hydrocarbons.

6. The process of claim 5 wherein the feedstream comprises a mixture of naphtha boiling range hydrocarbons.

7. The process of claim 5 wherein the feedstream comprises a mixture of kerosene boiling range hydrocarbons.

8. The process of claim 7 wherein the net bottoms stream comprises an admixture of isoparaffinic and normal paraffinic hydrocarbons.

9. A hydrocarbon separation process which comprises the steps:

(a) passing a feedstream, which stream comprises a first $C_5$-plus paraffinic hydrocarbon, a second paraffinic hydrocarbon and an olefinic hydrocarbon both having the same number of carbon atoms as said paraffinic hydrocarbon, and hydrogen into a hydrotreating zone comprising a first reaction zone containing a bed of solid catalyst and operated at hydrotreating conditions and producing a hydrotreating zone effluent stream which comprises hydrogen and said paraffinic and olefinic hydrocarbons and which contains less than about 0.05 mole percent olefinic hydrocarbons;

(b) passing the hydrotreating zone effluent stream into a stripping column operated at conditions effective to separate entering materials into a net overhead stream comprising hydrogen and a net bottoms stream comprising the first and second paraffinic hydrocarbons;

(c) collecting and withdrawing from the column as a first process stream substantially all of the liquid-phase hydrocarbons which are flowing downward through the column at a point which is below essentially all of the lowermost vapor-liquid contacting media present in the column and above a liquid retention volume provided in the bottom of the column;

(d) passing the first process stream through a second reaction zone comprising a bed of hydrogenation catalyst and operated at hydrogenation conditions and producing a second process stream comprising hydrogen and the paraffinic hydrocarbons;

(e) passing the second process stream into the liquid retention volume of the stripping column; and, (f) passing the net bottoms stream into an adsorptive separation zone wherein the net bottoms stream is contacted with a bed of a shape selective adsorbent under adsorptive separation conditions and thereby producing a third process stream which is rich in the first paraffinic hydrocarbon and a fourth process stream which is rich in the second paraffinic hydrocarbon, and withdrawing the third and fourth process streams from the process as product streams.

10. The process of claim 9 wherein the net bottoms stream comprises $C_8$-plus hydrocarbons.

11. The process of claim 10 wherein the net bottoms stream comprises an admixture of $C_{11}$ to $C_{15}$ hydrocarbons.

12. The process of claim 9 wherein the first reaction zone is operated at a pressure less than 5250 k Pag.

* * * * *